US008325952B2

(12) United States Patent
Cho

(10) Patent No.: US 8,325,952 B2
(45) Date of Patent: Dec. 4, 2012

(54) DIRECTIONAL SPEAKER SYSTEM AND AUTOMATIC SET-UP METHOD THEREOF

(75) Inventor: Sung-ho Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1211 days.

(21) Appl. No.: 11/780,618

(22) Filed: Jul. 20, 2007

(65) Prior Publication Data

US 2008/0165993 A1 Jul. 10, 2008

(30) Foreign Application Priority Data

Jan. 5, 2007 (KR) ..... 10-2007-0001714

(51) Int. Cl.
*H04R 5/02* (2006.01)

(52) U.S. Cl. ..... 381/300

(58) Field of Classification Search ..... 381/300, 381/310, 307
See application file for complete search history.

(56) References Cited

U.S. PATENT DOCUMENTS 3,418,436 A * 12/1968 Neumann ..... 381/174
7,564,979 B2 * 7/2009 Swartz ..... 381/60
2006/0083382 A1 * 4/2006 Sako et al. ..... 381/17
2007/0009120 A1 * 1/2007 Algazi et al. ..... 381/310
2007/0110268 A1 * 5/2007 Konagai et al. ..... 381/335
2008/0019535 A1 * 1/2008 Mitsuhashi et al. ..... 381/66
2008/0165979 A1 * 7/2008 Takumai ..... 381/59

FOREIGN PATENT DOCUMENTS

WO 2004066673 8/2004
WO 2006/001272 1/2006

OTHER PUBLICATIONS

Chinese Office Action Issued on Feb. 22, 2012 in CN Patent Application No. 200710148374.8.

* cited by examiner

*Primary Examiner* — Hai Phan
(74) *Attorney, Agent, or Firm* — Stanzione & Kim, LLP

(57) ABSTRACT

A directional speaker system and an automatic set-up method thereof, whereby a steering angle of the directional speaker system is automatically set up. The method includes generating a plurality of signals, converting the plurality of signals into a plurality of sound beams that orient virtual speaker candidate positions using a directional speaker, extracting a physical value to determine directivity from each of the plurality of sound beams input to a microphone, and setting a steering angle of a relevant virtual speaker position by comparing the physical values of the sound beams to each other.

24 Claims, 6 Drawing Sheets

DIRECTIONAL SPEAKER SYSTEM AND AUTOMATIC SET-UP METHOD THEREOF

CROSS-REFERENCE TO RELATED APPLICATIONS

This application claims priority under 35 U.S.C. §119(a) from Korean Patent Application No. 10-2007-0001714, filed on Jan. 5, 2007, in the Korean Intellectual Property Office, the disclosure of which is incorporated herein in its entirety by reference.

BACKGROUND OF THE INVENTION

1. Field of the Invention

The present general inventive concept relates to a front surround sound reproduction system using directional speakers, and more particularly, to a directional speaker system and an automatic set-up method thereof, whereby a steering angle of the directional speaker system is automatically set up.

2. Description of the Related Art

Conventionally, front surround sound reproduction systems create a stereoscopic feeling from a front speaker array without side or rear speakers using signal processing technology.

Front surround sound reproduction systems form sound beams from a surround channel signal using a directional speaker array and emit the sound beams to the wall so that reflection sounds reflected from the wall reach a listener. Thus, the listener can feel a stereoscopic effect due to the reflection of sounds as if the sounds are heard from side and rear speakers.

Front surround sound reproduction systems use a virtualizer, a rear reflector, and a directional speaker. Thus, front surround sound reproduction systems are classified into directional speaker systems and array-type sound systems.

Stereo sound performance of the directional speaker systems or the array-type sound systems depends on how to appropriately control a sound beam direction according to a listener and listening space. Control variables are an angle, strength, and arrival time difference of sound beams, and vary according to a geometric structure and material of the listening space. However, a set-up method for general users, who do not have technical knowledge of directional speakers and so are unable to easily set up and use the directional speaker systems or the array-type sound systems, is required.

A technique related to an automatic set-up method of an array-type sound system is disclosed in WO 04/066673 (filed 19 Jan. 2004 entitled SET-UP METHOD FOR ARRAY-TYPE SOUND SYSTEM).

FIG. 1 illustrates an array-type sound system using a conventional automatic set-up method. Referring to FIG. 1, a controller (not shown) controls C (center), Ls (Left surround), and Rs (Right surround) channel signals belonging to surround channels among 5.1 channels to have straightness in different directions. The controller controls a small aperture speaker array 10 to form sound beams 12-1 and a middle aperture speaker (not shown) to reproduce a middle and low frequency signal. The small aperture speaker array 10 forms sound beams 12-2 having straightness at appropriate angles so that surround channel signals are focused on the ears of a listener 13 after been reflected from side and rear walls 161. Thus, sounds reproduced by the small aperture speaker array 10 are reflected from the side and rear walls 161 so that the listener 13 feels a stereoscopic effect. The array-type sound system illustrated in FIG. 1 determines a first reflection angle and a distance from a reflection surface using a Sound Pressure Level (SPL) technique.

Thus, an automatic set-up method of the array-type sound system illustrated in FIG. 1 uses the SPL as a technique of emitting a test signal and determining a reflection angle of the test signal.

However, the conventional automatic set-up method illustrated in FIG. 1 has a disadvantage in that the set-up process fails when complicated reflection or diffusion occurs in an actual space, since the conventional automatic set-up method tries to measure a reflection position/angle with only the SPL. In addition, since the conventional automatic set-up method illustrated in FIG. 1 uses test signals, such as a Maximum Length Sequence (MLS), a user may find the set-up process very annoying.

SUMMARY OF THE INVENTION

The present general inventive concept provides a directional speaker system and an automatic set-up method thereof, whereby a sound beam direction of each channel is automatically set by analyzing a signal characteristic of a sound beam reflected in a desired direction in a directional speaker.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an automatic set-up method of a directional speaker system, the method including generating a plurality of random signals; converting the plurality of random signals into a plurality of sound beams that orient virtual speaker candidate positions using a directional speaker; extracting a physical value to determine directivity from each of the plurality of sound beams input to a microphone; and setting a steering angle of a relevant virtual speaker position by comparing the physical values of the sound beams to each other.

The foregoing and/or other aspects and utilities of the present general inventive concept may also be achieved by providing a directional speaker system including a directional speaker converting a plurality of signals, each having a different frequency, into a plurality of sound beams that orient virtual speaker candidate positions according to a plurality of set steering angles; a plurality of microphones to receive a plurality of sound beams of the directional speaker, which were reflected from a reflection wall; and a signal processing unit to generate a plurality of random signals, each having a different frequency and a different steering angle, to extract beam-forming power of each sound beam by beam-forming processing the plurality of sound beams input to the plurality of microphones, and to set a steering angle of a relevant virtual speaker position by comparing the beam-forming powers to each other.

The foregoing and/or other aspects and utilities of the present general inventive concept may also be achieved by providing a method to set-up a directional speaker system, the method including generating a plurality of test signals, generating a plurality sound beam at pre-determined steering angles according to the plurality of test signals using a directional speaker, determining a directivity and magnitude of the plurality of sound beams, comparing the directivity and magnitude of the plurality of sound beams at relevant virtual speaker positions, and setting a steering angle for relevant virtual speaker positions according to the comparison.

The generating of the plurality of sound beams may include generating a plurality of different monotone frequency signals.

The determining of the directivity and magnitude of the plurality of sound beams may include determining the directivity and magnitude of each of the plurality of sound beams simultaneously at each virtual speaker position.

The foregoing and/or other aspects and utilities of the present general inventive concept may also be achieved by providing a directional speaker system including a directional speaker to convert a plurality of signals, each having a different frequency, into a plurality of sound beams that orient virtual speaker candidate positions according to a plurality of set steering angles, a microphone module to receive the plurality of sound beams of the directional speaker reflected from a reflection wall, and a signal processing unit to generate a plurality of signals, each having a different frequency and a different steering angle, to determine a sound intensity of each sound beam by measuring the sound intensity of the plurality of sound beams input to the microphone module, and to set a steering angle of a relevant virtual speaker position by comparing the sound intensities to each other.

The microphone module may include a plurality of holes and a duct to detect a signal path difference.

The microphone module may be a microphone array.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
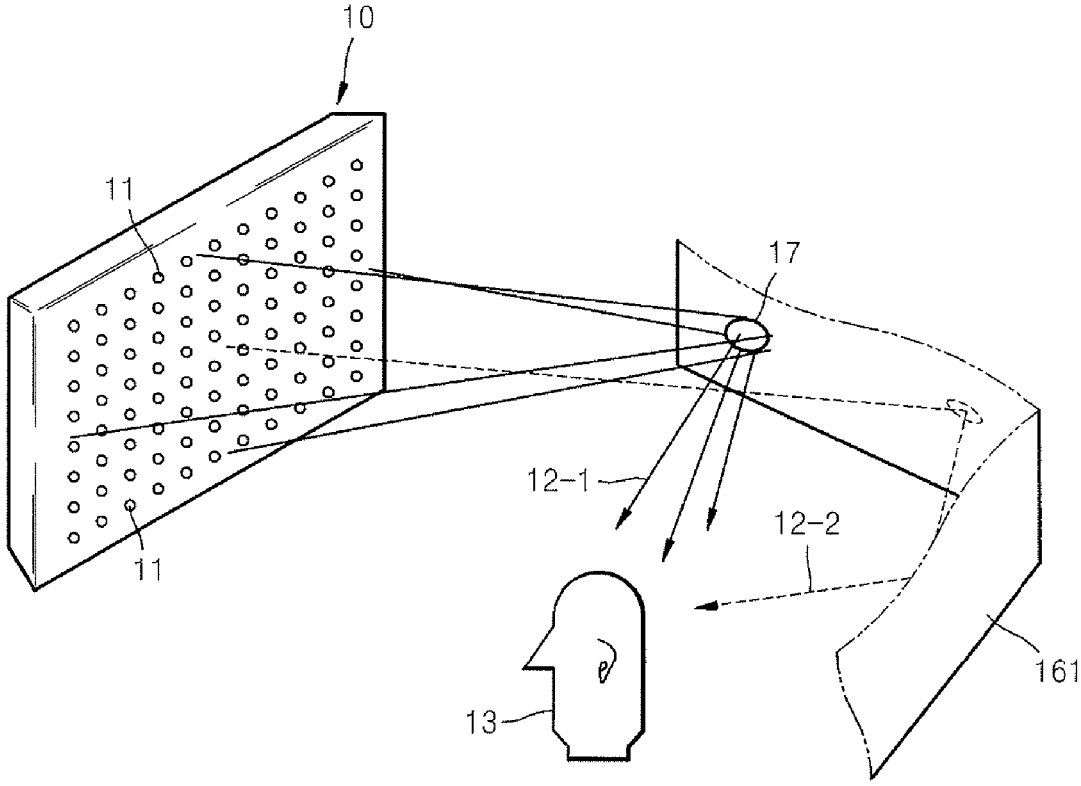
FIG. 1 (PRIOR ART)
FIG. 1 illustrates an array-type sound system using a conventional automatic set-up method.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
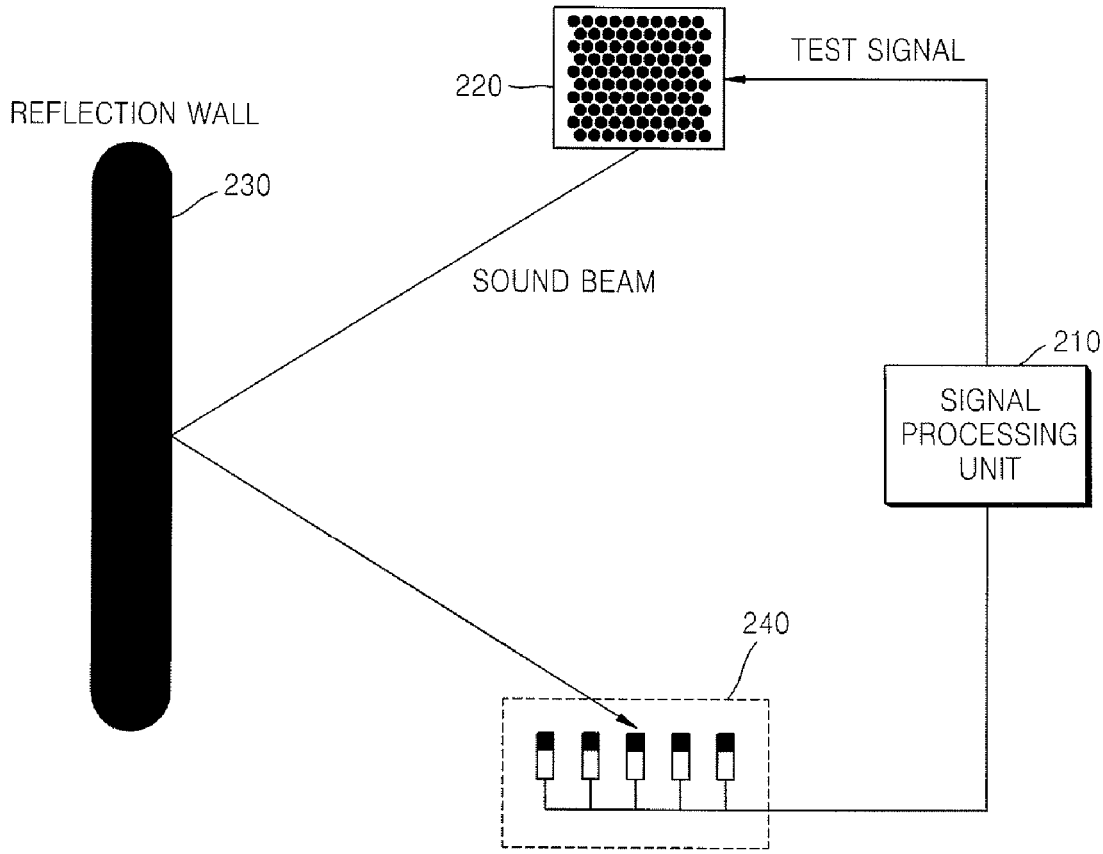
FIG. 2 is a schematic block diagram illustrating an automatic set-up apparatus of a directional speaker system according to an embodiment of the present general inventive concept.

FIG. 2 is a schematic block diagram illustrating an automatic set-up apparatus of a directional speaker system according to an embodiment of the present general inventive concept.

Referring to FIG. 2, the automatic set-up apparatus may include a signal processing unit 210, a directional speaker 220, and a microphone module 240.

The signal processing unit 210 can generate a plurality of test signals forming a chord in a measurement mode and can output the plurality of test signals to the directional speaker 220. In this case, the signal processing unit 210 can set in advance a steering angle control signal of a sound beam generated by the directional speaker 220 in response to each of the test signals and can output the steering angle control signals together with the plurality of test signals. The plurality of test signals are obtained by simultaneously reproducing a plurality of different monotone frequency signals, which can create a chord, in order to minimize a user's annoyance during a set-up process. For example, major triad, such as do, mi, sol, can be used, and a discord can be selected according to taste. A concord or a discord may be generated in a narrow band. The signal processing unit 210 can measure sound beam power or sound intensity by beam-forming processing or sound intensity measuring each of a plurality of sound beams input from a plurality of microphones of the microphone module 240, can compare the sound beam powers or sound intensities to each other, and sets a steering angle of a sound beam having the greatest sound beam power or sound intensity as a steering angle of a relevant virtual speaker position. The signal processing unit 210 can feed back direction information (steering angle control signal) of the relevant virtual speaker position to the directional speaker 220.

For example, the directional speaker 220 receives a steering angle control signal corresponding to each of the plurality of test signals from the signal processing unit 210 and converts the plurality of test signals to a plurality of sound beams that orient virtual speaker candidate positions according to the corresponding steering angle control signals. For example, the directional speaker 220 forms a plurality of sound beams having approximate candidate steering angles (e.g., 45°,50°,55°, etc.) corresponding to a virtual speaker position of an L (left) channel using the plurality of test signals. If it is assumed that 3 test signals having different frequencies are used, a sound beam having a steering angle of 45° can be formed from a first test signal, a sound beam having a steering angle of 50° can be formed from a second test signal, and a sound beam having a steering angle of 55° can be formed from a third test signal. The steering angles can be pre-set by the signal processing unit 210.

The microphone module 240 can include a microphone array or directional microphone to determine a reflection angle with which an optimal reflection is achieved and can receive a plurality of sound beams reflected from a reflection wall 230. For example, the microphone array can determine directivity of sound beams with more than two microphones having an interval less than half a wavelength of a frequency to be measured. Thus, the microphone array can obtain beam-forming power having the best Signal to Noise Ratio (SNR) when the microphone array is installed parallel to a wave front_of a sound wave propagated in a listening space. In addition, the directional microphone can determine directivity of sound beams with a plurality of holes and a duct to detect path differences of signals from the wave front.

Figure 3:
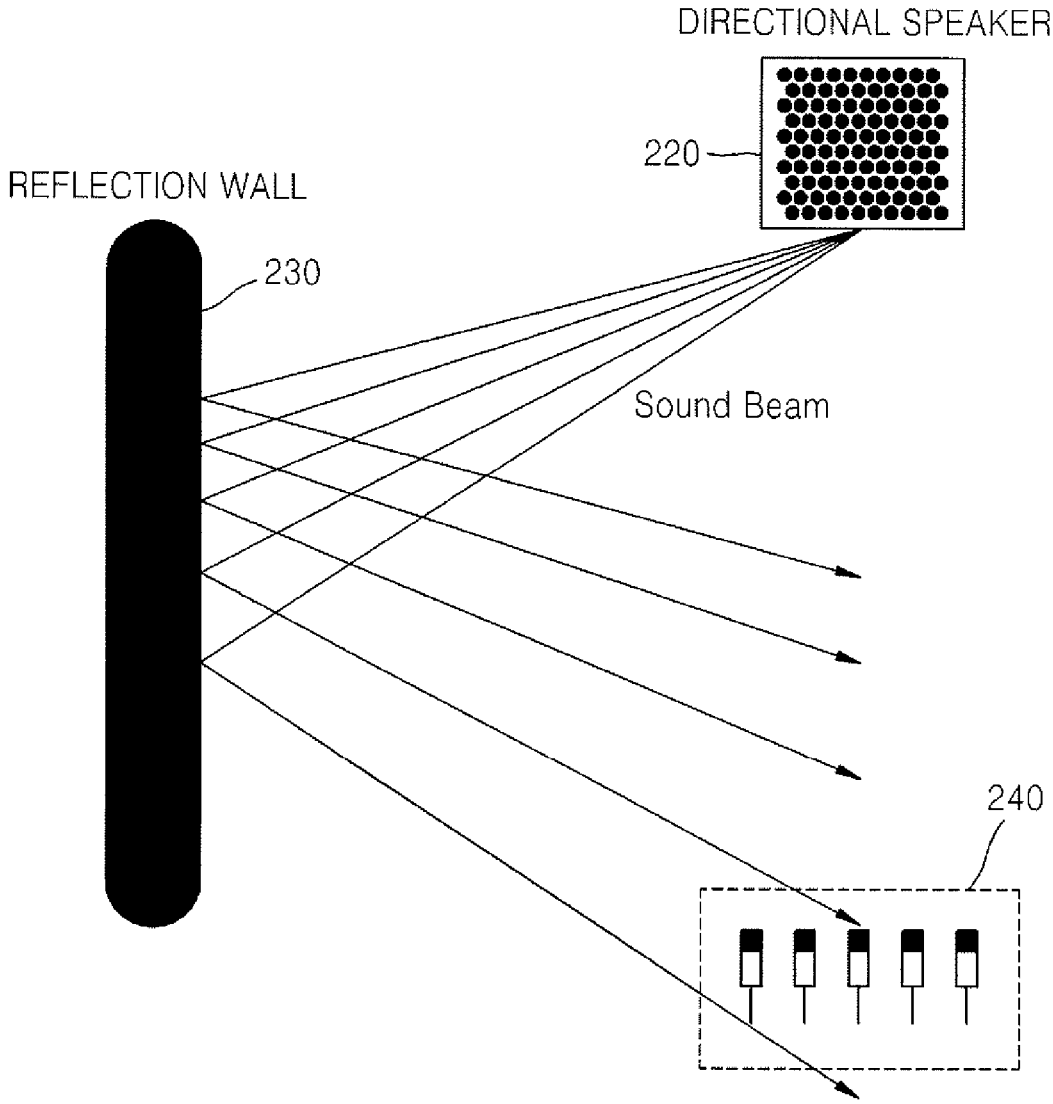
FIG. 3 is a conceptual diagram illustrating a plurality of sound beams generated from a plurality of test signals according to an embodiment of the present general inventive concept.

FIG. 3 is a conceptual diagram illustrating a plurality of sound beams generated from a plurality of test signals according to an embodiment of the present general inventive concept.

Referring to FIG. 3, the directional speaker 220 can form a plurality of sound beams according to a plurality of test signals input from the signal processing unit 210 using a small aperture speaker array. The plurality of sound beams output from the directional speaker 220 are reflected according to a characteristic of the reflection wall 230. A plurality of sound beams reflected by the reflection wall 230 are input to the microphone module 240.

Figure 4A:
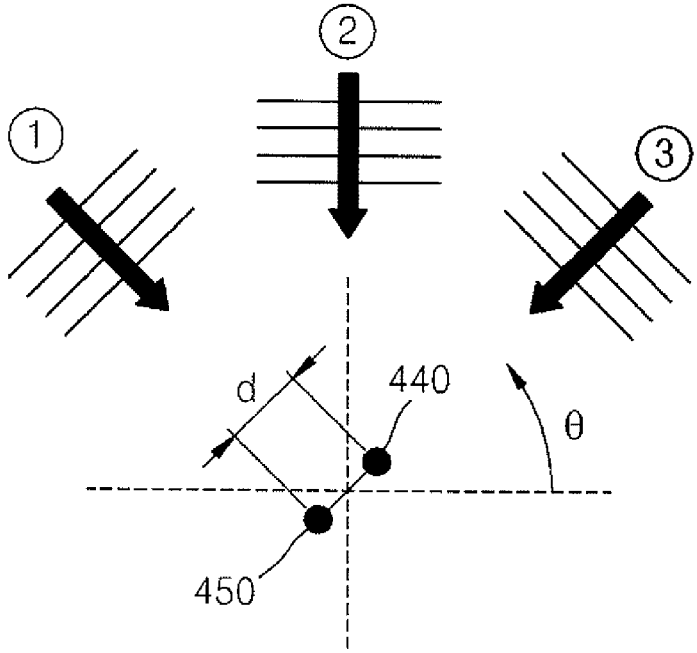
FIGS. 4A and 4B illustrate determining directivity of sound beams using a microphone array according to an embodiment of the present general inventive concept.
Figure 4B:
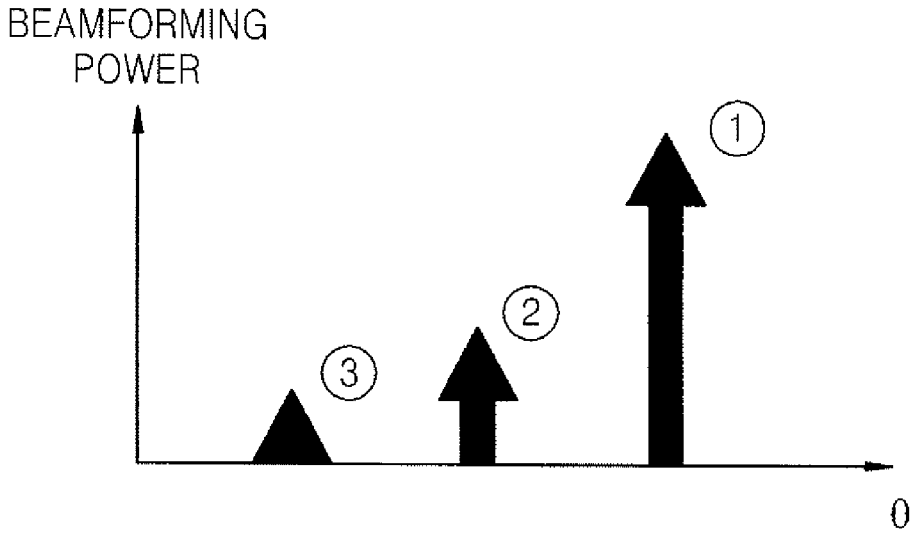

FIGS. 4A and 4B are diagrams illustrating determining directivity of sound beams using a microphone array according to an embodiment of the present general inventive concept.

The signal processing unit 210 can measure physical values to determine directivity, such as sound intensity or beam-forming power, from sound beams received via the microphone array of the microphone module 240. The sound intensity is a physical value indicating a propagation characteristic of a sound using a signal magnitude difference and a phase difference between two microphones. The sound intensity can be obtained by a self-correlation function and a mutual-correlation function between two signals. The signal processing unit 210 may determine directivity of sound beams using beam-forming processing used in common instead of using the sound intensity.

In an actual listening space, many noise signals other than test signals also exist. Thus, in order to extract only desired signals by excluding noise signals, a plurality of microphone arrays are used. A higher SNR can be obtained as the number of microphones increases.

For example, referring to FIG. 4A, two microphones 440 and 450 having a predetermined interval "d" therebetween and a predetermined slope θ receive a plurality of sound beams ①, ②, and ③ via a wave front. Thick arrows indicate orientations of respective sound beams, and the predetermined interval "d" and the predetermined slope θ are variable according to an object to be measured. The two microphones 440 and 450 may be located at a listening position of a user. The signal processing unit 210 obtains the beam-forming power of each of the sound beams ①, ②, and ③ input in respective directions by applying a beam-forming algorithm to the sound beams ①, ②, and ③ acquired via the two microphones 440 and 450.

Referring to a graph of beam-forming power according to an incident angle, which is illustrated in FIG. 4B, the first sound beam ① does not have a path difference between input times to the two microphones 440 and 450. Thus, the beam-forming power of the first sound beam ① is the greatest among beam-forming powers of the sound beams ①, ②, and ③. However, due to the path difference between input times to the two microphones 440 and 450, the beam-forming powers of the sound beams ②, and ③ decrease. Thus, the signal processing unit 210 determines a steering angle of the first sound beam ① corresponding to the greatest beam-forming power as an optimal sound beam steering angle.

Figure 5A:
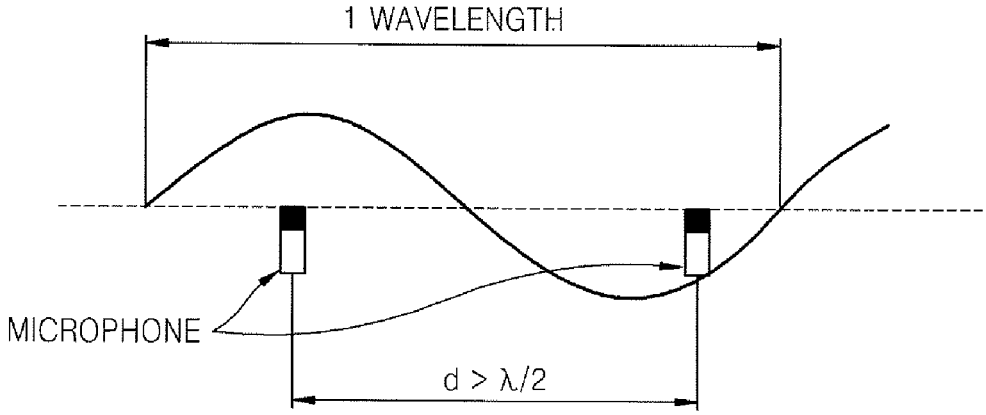
FIGS. 5A and 5B illustrate arrangement intervals of microphones according to an embodiment of the present general inventive concept.
Figure 5B:
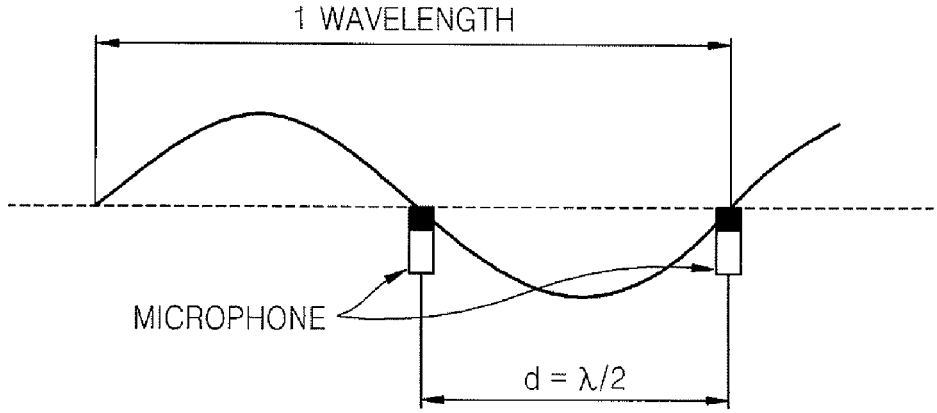

FIGS. 5A and 5B illustrate arrangement intervals of microphones according to an embodiment of the present general inventive concept.

If an interval "d" between two microphones is greater than half a wavelength as illustrated in FIG. 5A, sound beams are measured at a point at which a spatial aliasing effect occurs, and if the interval "d" between two microphones is equal to half a wavelength as illustrated in FIG. 5B, sound beams are measured at a singular point. Thus, the interval "d" between two microphones may be limited to within ½ of a wavelength corresponding to a frequency of a sound beam to be measured.

Figure 6:
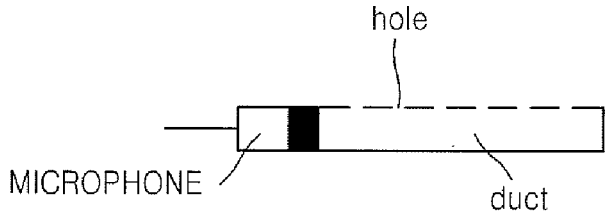
FIG. 6 illustrates a structure of a directional microphone.

FIG. 6 illustrates a structure of a directional microphone.

Referring to FIG. 6, the directional microphone may include a plurality of holes and a duct to detect a path difference between signals from a wave front.

Figure 7:
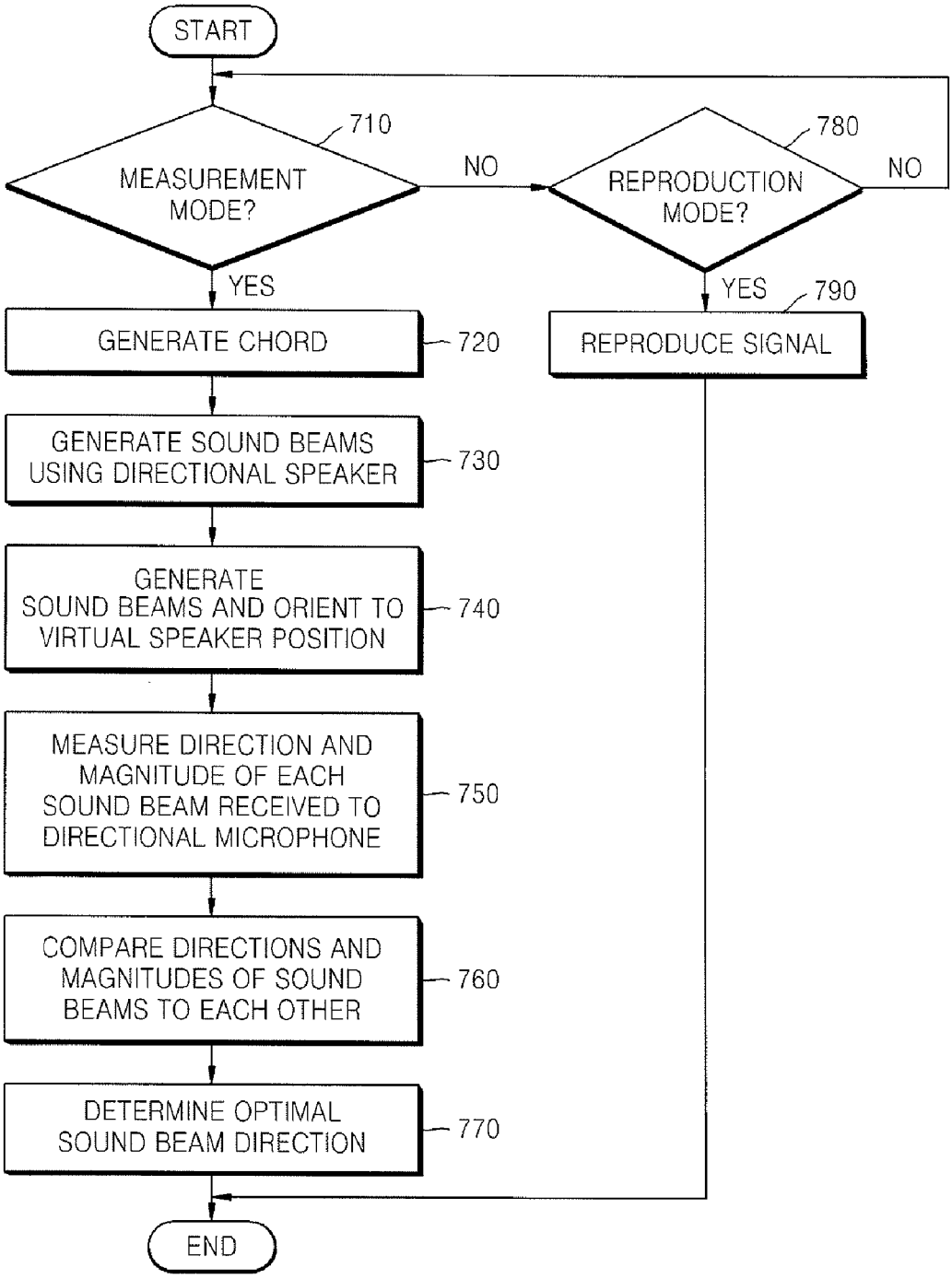
FIG. 7 is a flowchart of an automatic set-up method of a directional speaker system according to an embodiment of the present general inventive concept.

FIG. 7 is a flowchart of an automatic set-up method of a directional speaker system according to an embodiment of the present general inventive concept.

Referring to FIG. 7, it is determined in operation 710 whether a current mode is a measurement mode. If it is determined in operation 710 that the current mode is not the measurement mode, and if it is determined in operation 780 that the current mode is a reproduction mode, a signal is reproduced in operation 790.

If it is determined in operation 710 that the current mode is the measurement mode, a plurality of monotones, which can create a chord, are simultaneously generated in operation 720.

The plurality of monotones are converted into a plurality of sound beams that orient virtual speaker candidate positions using a directional speaker in operation 730. In this case, the plurality of sound beams are formed from the plurality of monotones using a plurality of pre-set steering angles.

The plurality of sound beams are emitted to a virtual speaker position via a reflection wall in operation 740.

A physical value, such as beam-forming power or sound intensity, to determine directivity is extracted from each of the plurality of sound beams received via a microphone array or a directional microphone in operation 750. For example, beam-forming powers of the plurality of sound beams received via the microphone array or the directional microphone are measured using a beam-forming algorithm. The direction and magnitude of each sound beam are represented by the beam-forming power. In another embodiment, sound intensity is extracted using a signal magnitude difference and a phase difference between two microphones.

Directions and magnitudes of the plurality of sound beams are compared to each other using the beam-forming powers or sound intensities of the plurality of sound beams in operation 760.

A sound beam having the greatest physical value (beam-forming power or sound intensity) is detected from among the plurality of sound beams, and a steering angle corresponding to the detected sound beam is set as a steering angle of the virtual speaker position in operation 770. In this case, the steering angle corresponding to the detected sound beam is pre-set. That is, since the signal processing unit 210 knows a frequency characteristic of each sound beam in advance, the signal processing unit 210 can identify the sound beam having the greatest beam-forming power or sound intensity and know the steering angle of the sound beam.

Finally, each signal of the L, R, C, Ls, Rs channels can be set to be reflected in a desired direction in which the signal is spatially reproduced.

In another embodiment, a test signal having the highest SNR is obtained, sound beams minutely controlled around a direction of the test signal are generated, and a minute sound beam steering angle is generated using the sound beams.

The general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion.

As described above, according to various embodiments of the present general inventive concept, orientations of spatially distributed sound beams can be accurately detected using a microphone array and a beam-forming algorithm. In addition, by generating a plurality of test signals forming a chord, set-up of a directional speaker can be quickly accomplished, thus minimizing annoyance to a user.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An automatic set-up method of a directional speaker system, the method comprising:

generating a plurality of signals;

forming a plurality of sound beams having candidate steering angles corresponding to a virtual speaker position using the plurality of signals, extracting a physical value to determine directivity from each of the plurality of sound beams input to two microphones;

measuring path differences between input times of the plurality of sound beams to the two microphones; and setting the steering angle of the virtual speaker position by comparing the physical values and path differences of the sound beams to each other, the steering angle corresponding to a sound beam having the greatest physical value.

2. The method of claim 1, wherein the forming a plurality of sound beams comprises:

setting steering angles of the plurality of signals; and forming the plurality of sound beams that orient virtual speaker candidate positions from the plurality of signals according to the steering angles.

3. The method of claim 1, wherein the plurality of signals are one of a plurality of monotones, concords, and discords.

4. The method of claim 1, wherein the plurality of signals have different frequencies.

5. The method of claim 1, wherein the microphones are a microphone array.

6. The method of claim 5, wherein the microphone array comprises two or more microphones having an interval less than half a wavelength of a frequency to be measured.

7. The method of claim 1, wherein the plurality of sound beams are simultaneously or sequentially generated towards the virtual speaker positions.

8. The method of claim 1, wherein the extracting of the physical value comprises extracting beam-forming power of each sound beam by beam-forming processing the sound beam based on a path difference of the sound beam input to the microphone.

9. The method of claim 1, wherein the extracting of the physical value comprises extracting sound intensity using a signal magnitude difference and a phase difference.

10. The method of claim 1, wherein the setting of the steering angle comprises comparing beam-forming powers of the plurality of sound beams to each other, selecting a sound beam having the greatest beam-forming power from among the plurality of sound beams, and setting a steering angle of the selected sound beam as a steering angle of a virtual speaker position.

11. The method of claim 1, wherein the setting of the steering angle comprises comparing sound intensities of the plurality of sound beams to each other, selecting a sound beam having the greatest sound intensity from among the plurality of sound beams, and setting a steering angle of the selected sound beam as a steering angle of a virtual speaker position.

12. The method of claim 10, wherein the beam-forming powers are generated according to temporal path differences of the plurality of sound beams input to more than one microphone.

13. A directional speaker system comprising:

a directional speaker to convert a plurality of signals, each having a different frequency, into a plurality of sound beams that orient virtual speaker candidate positions according to a plurality of set steering angles;

a microphone module including only two microphones to receive the plurality of sound beams of the directional speaker reflected from a reflection wall; and a signal processing unit to extract beam-forming power of each sound beam by beam-forming processing the plurality of sound beams input to the microphone module, measure path differences between input times of the plurality of sound beams to the two microphones, and to set a predetermined steering angle of a relevant virtual speaker position by comparing the beam-forming powers and path differences to each other, the predetermined steering angle corresponding to a sound beam having the greatest physical value.

14. The directional speaker system of claim 13, wherein the microphone module comprises a plurality of holes and a duct to detect a signal path difference.

15. The directional speaker system of claim 13, wherein the microphone module is a microphone array.

16. A non-transitory computer readable recording medium comprising computer readable codes to execute an automatic set-up method of a directional speaker system, the method comprising:

generating a plurality of signals;

forming a plurality of sound beams having candidate steering angles corresponding to a virtual speaker position using the plurality of signals;

extracting a physical value to determine directivity from each of the plurality of sound beams input to two microphones;

measuring path differences between input times of the plurality of sound beams to the two microphones; and setting the steering angle of the virtual speaker position by comparing the physical values and path differences of the sound beams to each other, the steering angle corresponding to a sound beam having the greatest physical value.

17. A method to set-up a directional speaker system, the method comprising:

generating a plurality of test signals;

generating a plurality sound beams at pre-determined steering angles according to the plurality of test signals using a directional speaker;

determining a directivity and magnitude of each of the plurality of sound beams input to two microphones;

measuring a path difference between input times of the plurality of sound beams to the two microphones;

comparing the directivity and magnitude of each of the plurality of sound beams and path differences at relevant virtual speaker positions; and setting a steering angle for relevant virtual speaker positions according to the comparisons.

18. The method of claim 17, wherein the generating of the plurality of sound beams comprises generating a plurality of different monotone frequency signals.

19. The method of claim 17, wherein the determining of the directivity and magnitude of the plurality of sound beams comprises determining the directivity and magnitude of each of the plurality of sound beams simultaneously at each virtual speaker position.

20. A directional speaker system comprising:

a directional speaker to generate a plurality of signals and form a plurality of sound beams having candidate steering angles corresponding to a virtual speaker position using the plurality of signals;

a microphone module including only two microphones to receive the plurality of sound beams of the directional speaker reflected from a reflection wall; and a signal processing unit to determine a sound intensity of each sound beam by measuring the sound intensity and path differences between input times of the plurality of sound beams input to the microphone module, and to set the steering angle of the virtual speaker position by comparing the sound intensities and path differences to each other.

21. The directional speaker system of claim 20, wherein the microphone module comprises a plurality of holes and a duct to detect a signal path difference.

22. The directional speaker system of claim 20, wherein the microphone module is a microphone array.

23. A method to set-up a directional speaker system, the method comprising:

generating a chord comprising a plurality of monotones;

generating a plurality of sound beams oriented to a plurality of virtual speaker candidate positions;

emitting the plurality of sound beams to at least one of the plurality of virtual speaker candidate positions via a reflecting wall;

measuring and comparing a direction value and a magnitude value for each of the plurality of sound beams received at a microphone module that includes two microphones; and determining one of the plurality of sound beams to be optimal by measuring a path difference between input times of the plurality of sound beams of the microphone module and using the optimal sound beam to select a steering angle.

24. The method of claim 23, wherein the optimal sound beam has a frequency characteristic that corresponds to a pre-set steering angle.

* * * * *